US011565395B2

(12) United States Patent
Boeck et al.

(10) Patent No.: US 11,565,395 B2
(45) Date of Patent: Jan. 31, 2023

(54) PORTABLE POWER TOOL

(71) Applicant: Robert Bosch GmbH, Stuttgart (DE)

(72) Inventors: Cornelius Boeck, Kirchheim (DE); Daniel Barth, Leinfelden-Echterdingen (DE); Rainer Vollmer, Neuhausen (DE); Sinisa Andrasic, Schoenaich (DE); Manfred Lutz, Filderstadt (DE); Andreas Wolf, Stuttgart (DE); Peter Stierle, Pliezhausen (DE)

(73) Assignee: Robert Bosch GmbH, Stuttgart (DE)

( * ) Notice: Subject to any disclaimer, the term of this patent is extended or adjusted under 35 U.S.C. 154(b) by 797 days.

(21) Appl. No.: 16/476,831

(22) PCT Filed: Dec. 20, 2017

(86) PCT No.: PCT/EP2017/083861
§ 371 (c)(1),
(2) Date: Jul. 9, 2019

(87) PCT Pub. No.: WO2018/137861
PCT Pub. Date: Aug. 2, 2018

(65) Prior Publication Data

US 2019/0375089 A1 Dec. 12, 2019

(30) Foreign Application Priority Data

Jan. 27, 2017 (DE) ..... 10 2017 201 311.7

(51) Int. Cl.
*B25F 5/02* (2006.01)
*B24B 23/02* (2006.01)

(52) U.S. Cl.
CPC ..... *B25F 5/02* (2013.01); *B24B 23/028* (2013.01)

(58) Field of Classification Search
CPC ..... B25F 5/02; B24B 23/028
See application file for complete search history.

(56) References Cited

U.S. PATENT DOCUMENTS 2,062,969 A 12/1936 Dutcher
3,847,233 A * 11/1974 Glover ..... H01H 3/20 200/318.2

(Continued)

FOREIGN PATENT DOCUMENTS

CN 1245967 A 3/2000
CN 101150018 A 3/2008

(Continued)

OTHER PUBLICATIONS

International Search Report corresponding to PCT Application No. PCT/EP2017/083861, dated Apr. 18, 2018 (German and English language document) (6 pages).

*Primary Examiner* — Nathaniel C Chukwurah
*Assistant Examiner* — Lucas E. A. Palmer
(74) *Attorney, Agent, or Firm* — Maginot, Moore & Beck LLP

(57) ABSTRACT

A portable power tool, in particular an angle grinder, includes a housing that accommodates a drive and an electronic device with an interface configured to electrically connect the electronic device. The power tool further includes a housing inner part that is configured as a drive housing and supports the electronic device. The interface has at least one first electrical interface contact region and at least one second interface contact region spaced apart from the first interface contact region. At least one insulating element spaced apart from the interface contact regions is arranged between the housing inner part and the electronic device. The insulating element is configured to avoid an electrical short-circuiting connection between the first interface contact region and the second interface contact region.

18 Claims, 10 Drawing Sheets

(56) References Cited

U.S. PATENT DOCUMENTS 4,348,603 A * 9/1982 Huber ..... H01H 9/063 200/522
4,370,579 A * 1/1983 Kobayashi ..... H02K 23/66 310/239
4,536,670 A * 8/1985 Mayer ..... H01R 39/58 310/249
4,991,472 A * 2/1991 Hollingsworth ..... B25B 21/02 81/464
5,170,851 A * 12/1992 Kress ..... B25F 5/008 310/47
5,184,039 A * 2/1993 Kraft ..... H02K 5/148 310/90
5,293,156 A * 3/1994 Shoji ..... G01R 31/387 340/661
5,793,141 A * 8/1998 Simonsen ..... H02K 23/66 310/248
5,963,011 A 10/1999 Haller et al.
6,087,754 A * 7/2000 Berger ..... H01R 39/381 310/248
6,120,362 A * 9/2000 Etter ..... B25F 5/02 451/354
6,296,427 B1 * 10/2001 Potter ..... B25F 5/001 408/124
6,515,399 B1 * 2/2003 Lauf ..... H02K 5/145 310/239
6,602,122 B1 * 8/2003 Rudolf ..... B24B 23/005 451/344
6,731,503 B2 * 5/2004 Privett ..... H05K 7/209 361/679.01
8,066,533 B2 * 11/2011 Tomita ..... B25F 5/02 439/668
9,956,676 B2 * 5/2018 Wong ..... B24B 23/04
10,404,136 B2 * 9/2019 Oktavec ..... B25F 5/008
10,586,665 B2 * 3/2020 Esenwein ..... H01H 21/24
10,717,182 B2 * 7/2020 Chen ..... B24B 23/02
2003/0190877 A1 * 10/2003 Gallagher ..... B24B 55/00 451/344
2006/0276114 A1 * 12/2006 Gallagher ..... B24B 45/006 451/344
2007/0079980 A1 * 4/2007 Kononenko ..... H02K 11/33 173/90
2007/0264869 A1 * 11/2007 Habele ..... H02K 11/28 439/529
2008/0223594 A1 * 9/2008 Eisenhardt ..... B25F 5/006 173/162.2
2008/0265695 A1 * 10/2008 Yoshida ..... H02K 5/20 310/50
2010/0314147 A1 * 12/2010 Muller ..... B25F 5/006 173/171
2011/0031825 A1 * 2/2011 Sengiku ..... H02K 11/28 310/50
2013/0033846 A1 * 2/2013 Allner ..... B25F 5/02 361/827
2014/0242890 A1 * 8/2014 Boeck ..... B24B 47/12 173/1
2015/0151420 A1 * 6/2015 Zhang ..... B25F 5/008 310/50
2016/0129540 A1 * 5/2016 Tiede ..... B23Q 11/0046 173/197
2016/0358726 A1 * 12/2016 Saito ..... B25F 5/02
2017/0136614 A1 * 5/2017 Takeda ..... B24B 23/02
2017/0246735 A1 * 8/2017 Hashimoto ..... H02K 11/00
2018/0099372 A1 * 4/2018 Takeda ..... B24B 23/02
2019/0047115 A1 * 2/2019 Nakamura ..... B24B 23/02
2019/0358802 A1 * 11/2019 Trick ..... B25F 5/02
2020/0391370 A1 * 12/2020 Stierle ..... H05K 5/0217

FOREIGN PATENT DOCUMENTS

CN 101574804 A 11/2009
CN 103153536 A 6/2013
CN 103311032 A 9/2013
CN 204123373 U 1/2015
DE 37 40 200 A1 6/1989
DE 195 27 201 A1 1/1997
DE 196 16 764 A1 11/1997
DE 10 2007 043 918 A1 4/2009
DE 10 2010 035 170 A1 2/2012
DE 10 2010 042 016 A1 4/2012
DE 10 2012 223 717 A1 6/2014
DE 10 2013 200 708 A1 7/2014

* cited by examiner

PORTABLE POWER TOOL

This application is a 35 U.S.C. § 371 National Stage Application of PCT/EP2017/083861, filed on Dec. 20, 2017, which claims the benefit of priority to Serial No. DE 10 2017 201 311.7, filed on Jan. 27, 2017 in Germany, the disclosures of which are incorporated herein by reference in their entirety.

BACKGROUND

The disclosure relates to a portable power tool, in particular an angle grinder.

Portable power tools having a housing and having an electronic unit accommodated in the interior of the housing are known from the prior art. This electronic unit is inserted in the housing in such a way that the electronic unit is held positively and/or nonpositively relative to the housing in the housing. Owing to manufacturing tolerances, it is not possible to prevent the formation of gaps between the electronic unit and the housing. These gaps can fill with contaminants.

SUMMARY

It is the underlying object of the disclosure to improve a portable power tool, in particular an angle grinder, by simple design measures.

The object is achieved by a portable power tool, in particular an angle grinder, comprising a housing, which has in particular at least one housing cover or one housing half-shell and in which a drive and an electronic device having an interface for electrically connecting the electronic device are accommodated, and a housing inner part, which is configured in particular as a drive housing and supports the electronic device, wherein the interface has at least one first electrical interface contact region and at least one second interface contact region spaced apart from the first interface contact region.

According to the disclosure, at least one insulating element spaced apart from the interface contact regions is arranged between the housing inner part and the electronic device, said insulating element being intended to avoid an electrical short-circuiting connection between the first interface contact region and the second interface contact region.

During machining of metal workpieces, for example, small metal chips/particles are separated from the workpiece and enter the proximate environment. These metal chips/particles can pass from the environment into the portable power tool by being sucked into air inlet openings in the portable power tool, for example, and entering the interior of the angle grinder together with cooling air that is cooling the portable power tool. During this process, the metal chips/particles can be deposited or settle in the interior of the portable power tool and thereby contaminate and clog the portable power tool.

Particularly in enterprises such as fettling shops, the users wear protective clothing and respiratory protection gear to protect themselves against the metal chips in the air and, in addition, seal their clothing off in the neck region, around the wrists and ankles with adhesive tape to ensure that the fine metal chips/particles circulating as metal dust in the ambient air cannot penetrate via the gaps between two adjacent pieces of clothing.

Since the metal chips/particles are generally good electric conductors, the metal chips/particles can lead to a short circuit if adjacent electrical interface contact regions become clogged with metal chips/particles. This can lead to the failure of components, with the formation, for example, of leakage currents within the device and the formation of an electrical connection between two adjacent interface contact regions, for example. Owing to manufacturing tolerances of two adjacent components to be installed within the portable power tool, gaps between the components to be installed generally can be expected. These manufacturing tolerances can lead to gaps filling with metal chips/particles.

The portable power tool can be designed as an angle grinder and can form a grinding, parting or polishing machine, for example.

The housing inner part can be intended to leave the components, e.g. the electronic device, exposed in an unassembled state and to support said components positively and/or nonpositively in the housing, in particular the housing inner part, in an assembled state. As part of manufacture, tolerances can arise between the inner part of the housing and the components, and these can form a gap between the components and the housing inner part.

The housing can be formed in one piece with the housing inner part. In an assembled state of the portable power tool, the housing inner part is surrounded by a further housing, in particular designed as a housing cover.

The interface of the electronic device is embodied as an electrical interface and is intended to allow an electrical connection to a power supply unit, e.g. a mains connector or an electrical power storage device designed as a battery pack. Electrical interfaces of this kind are part of the prior art and are sufficiently well known to a person skilled in the art, and therefore such interfaces will not be explained in greater detail.

Interfaces of this kind have at least two interface contact surfaces, which are intended to produce an electric current flow which flows through the electronic device at least in part when the electronic device is actuated and is transmitted at least in part to the second interface contact region from the first interface contact region, for example.

In particular, the interface contact regions can be exposed in an outer region of the electronic device. The interface contact regions can preferably project in an outer region of the electronic device in order to ensure good accessibility of the interface contact regions.

The interface contact regions are of electrically conductive design. The interface contact regions can contain a metal material or consist thereof.

The portable power tool can have leads which are connected to the interface contact regions and are intended to conduct electric current.

An "electronic device" is intended, in particular, to mean a device which influences at least one electric current in a gas, in a conductor, in a vacuum and/or, advantageously, in a semiconductor. The electronic device can preferably have at least one transistor, in particular at least one microprocessor. The electronic device can preferably have a switch.

In particular, the insulating element can be used, in the event of an accumulation of metal chips/particles within the housing, to increase a minimum possible distance between the metal chips and the interface contact regions by arranging the insulating element between the interface contact regions.

In particular, the insulating element can be formed in one piece or from a coherent part or can be formed in several parts or from a plurality of insulating elements arranged in series. In this case, the insulating elements can be designed as flat insulating strips. The insulating element can preferably be formed from a material through which it is impossible per se for dust, in particular metal dust, to flow, and therefore it is not possible for any metal chips/particles to pass through the insulating element.

In this context, an "insulating element" should be taken to mean, in particular, a layer which has a high insulation resistance and/or a low electrical conductivity. The insulating layer is preferably composed at least partially of a material which has a high insulation resistance. In this context, a "high insulation resistance" should be taken to mean a resistance of at least 50Ω, preferably of at least 300Ω and particularly preferably at least 500Ω. It is furthermore proposed that the insulating layer should be composed at least partially of an engineering plastic.

In particular, the insulating element can be flexible and compressible, and this should be taken, in particular, to mean an element which has at least one extent which, in a normal operating state, can vary flexibly by at least 10%, in particular by at least 20%, preferably by at least 30% and particularly preferably by at least 50% and which, in particular, produces a counterforce dependent on a change in the extent and preferably proportional to the extent, which counteracts the change. An "extent" of an element should be taken to mean, in particular, a maximum distance between two points in a vertical projection of the element onto a plane. It is thereby possible to compensate for tolerance differences between housing inner parts and the electronic device.

The dependent claims indicate expedient developments of the portable power tool according to the disclosure.

It may be expedient if the insulating element forms a first chamber region and a second chamber region, which is spaced apart from the first chamber region, at least in some section or sections, wherein the insulating element separates the first chamber region from the second chamber region, at least in some section or sections, along a plane which, in particular, extends parallel and/or orthogonally to a main direction of extent of the portable power tool, wherein the first chamber region has the first interface contact region, and the second chamber region has the second interface contact region. It is thereby possible to ensure that a minimum distance between the two interface contact regions is increased. A chamber should be taken to mean a gap which is bounded, at least in some section or sections, by the housing inner part and the electronic device, for example, and, in particular, is bounded at least in some section or sections between the insulating element and the chamber region. In particular, the chamber region can be formed as a gap between the housing inner part and the electronic device.

It may furthermore be expedient if the insulating element is designed as a filling element. In particular, the insulating element can be of elastically deformable design. As a preferred possibility, the filling element can be intended to fill a clearance between the housing inner part and the electronic device. As a result, the insulating element can separate or insulate the two interface contact regions from one another in a particularly simple way. It is furthermore thereby possible to achieve a preload between the housing inner part and the electronic device, thus enabling microvibrations between the electronic device and the housing inner part to be reliably damped.

Since the insulating element can be employed in existing portable power tools, an insulating element composed of a compressible material could be preferred. Alternatively, the insulating element can contain a material or be composed of a material which is less flexible than a material which the housing inner part contains or of which it is composed.

In particular, the insulating element can be provided between an electronic device and a magnetic wheel region, wherein the magnetic wheel region forms a region in the direct vicinity of the electric motor.

It may furthermore be expedient if the clearance has an extent between the housing inner part and the electronic device of less than 2 mm, in particular less than 1.5 mm, preferably less than 1.2 mm, preferably less than 1 mm, as a further preference less than 0.8 mm, and particularly preferably less than 0.6 mm. It is thereby possible to reduce or avoid gaps between the housing inner part and the electronic device.

The insulating element can extend between the housing inner part and the electronic device in such a way that the insulating element fills an extent of the clearance between the housing inner part and the electronic device, in particular completely. In this case, the insulating element can, in particular, be designed with a flexibility such as to ensure that the clearance between the housing inner part and the electronic device is filled.

The insulating element can preferably have a material aperture which extends through the entire material thickness of the insulating element and which can be designed, for example, as a slot. In this case, the material aperture can be completely surrounded by the insulating element. It is thereby possible to reduce assembly forces in the assembly of the electronic device with the housing inner part.

As an alternative, the insulating element can extend in such a way that the insulating element only partially fills an extent of the clearance between the housing inner part and the electronic device. In this case, the insulating element can have an extent between the housing inner part and the electronic device which is less than 1.5 mm, in particular less than 1.2 mm, preferably less than 1.0 mm, preferably less than 0.8 mm and as a further preference less than 0.6 mm and is intended to reduce or completely fill the clearance between the housing inner part and the electronic device.

It is furthermore proposed that the electronic device be designed as an electric on/off switch and/or as an electric open-loop and/or closed-loop control unit. An "open-loop and/or closed-loop control unit" should be taken to mean, in particular, a unit which has at least one electronic control system, which should, in particular, form a unit which has a processing unit and a memory unit as well as an operating program stored in the memory unit.

It may furthermore be expedient for the insulating element to surround the electronic device, in particular an on/off switch, in a C shape. In particular, the insulating element can delimit at least three sides of the electronic device in at least one plane. It may furthermore be expedient for the insulating element to surround the electronic device, in particular the on/off switch, in an L shape and, in particular, to delimit at least two sides of the electronic device in at least one plane. The insulating element can preferably be arranged on the electronic device in such a way that the insulating element extends at least substantially in a direction away from the interface contact regions. It is thereby possible to separate the interface contact regions from one another in a particularly effective manner. The electronic device designed as an on/off switch may expediently have a switch actuating element designed as a push button, which is intended to actuate the on/off switch. As a preferred option, the interface contact regions can be arranged on a side of the on/off switch facing away from the switch actuating element.

It is proposed that a further insulating element, which is intended to avoid an electrical short-circuiting connection between the first interface contact region and the second interface contact region, be arranged between the housing inner part and the electronic device, in particular an open-loop and/or closed-loop control unit. It is thereby possible to prevent an accumulation of metal chips.

It is furthermore proposed that the insulating element be designed as an integral shaped stamped part, which, in particular, contains or consists of a foam, preferably a PU foam. In particular, the insulating element can contain or consist of a plastics material and, preferably, a material such as TPE or NBR can be used as the plastics material. As a preferred option, the insulating element can have a material thickness of more than 0.8 mm, in particular more than 1 mm. In this case, a plastics material such as moss rubber with a material thickness of about 1.2 mm can be used. In particular, the insulating element can be of T-shaped design, preferably forming a T shape from two separate insulating strips. As a result, the insulating element can be of particularly simple design.

It may be expedient if the insulating element is designed as a film which has at least one film surface having a self-adhesive layer for connecting the film to the housing inner part and/or the electronic device. In particular, the insulating element can be bonded onto a housing inner part and/or the electronic device, in particular by means of the self-adhesive layer. As an alternative, the insulating element can be placed on the housing inner part, with the result that the insulating element is held nonpositively or clamped between the housing inner part and the electronic device. As an alternative, the insulating element can be molded onto the housing inner part or onto the electronic device. As a further alternative, the insulating element can be foamed onto the housing inner part or onto the electronic device. It is thereby possible to produce the portable power tool in a particularly simple manner.

It may furthermore be expedient if the electronic device, in particular an on/off switch, has a first labyrinth seal element, and the housing inner part has a second labyrinth seal element. In particular, the insulating element can be arranged in or on the first and/or second labyrinth seal element and can be intended to prevent material transport. In particular, the first labyrinth seal element can be designed as a sealing groove. The second labyrinth seal element can preferably be designed as a sealing protrusion. The first and/or the second labyrinth seal element can be intended to form a labyrinth seal. Through the combination of a labyrinth seal with the insulating element, material transport, e.g. of metal dust containing metal chips, can be avoided.

BRIEF DESCRIPTION OF THE DRAWINGS

Further advantages will become apparent from the following description of the drawings. The drawings illustrate illustrative embodiments of the disclosure. The drawings, the description and the claims contain numerous features in combination. A person skilled in the art will also expediently consider the features individually and combine them into worthwhile further combinations. In the drawings:

DETAILED DESCRIPTION

In the following description of the figures, identical components are provided with the same reference signs.

Figure 1:
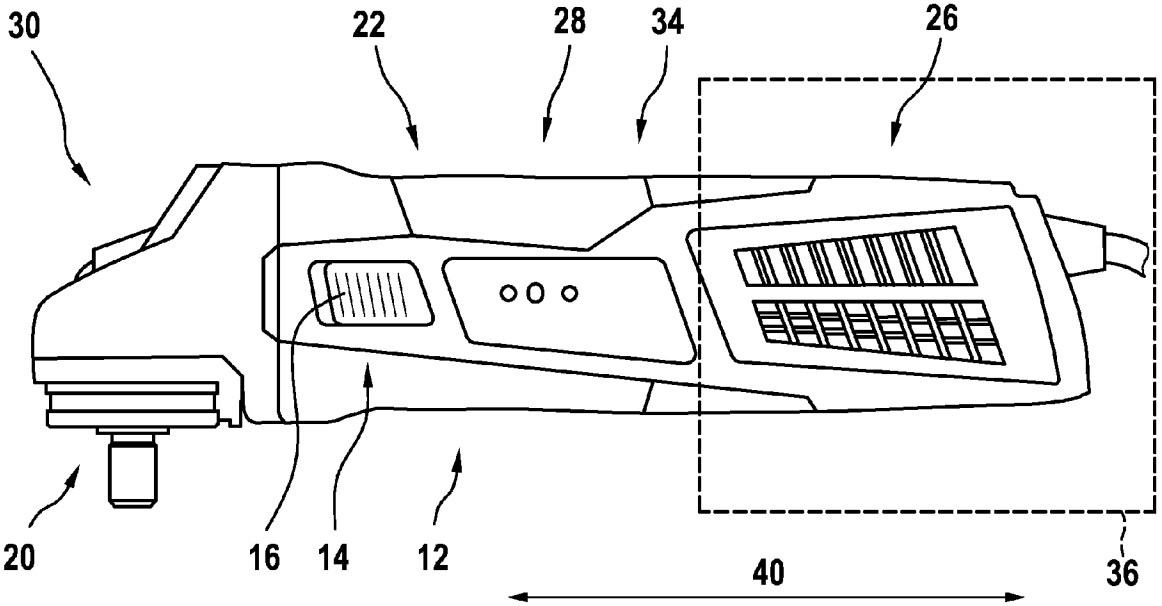
FIG. 1 shows a perspective view of a portable power tool.
Figure 2:
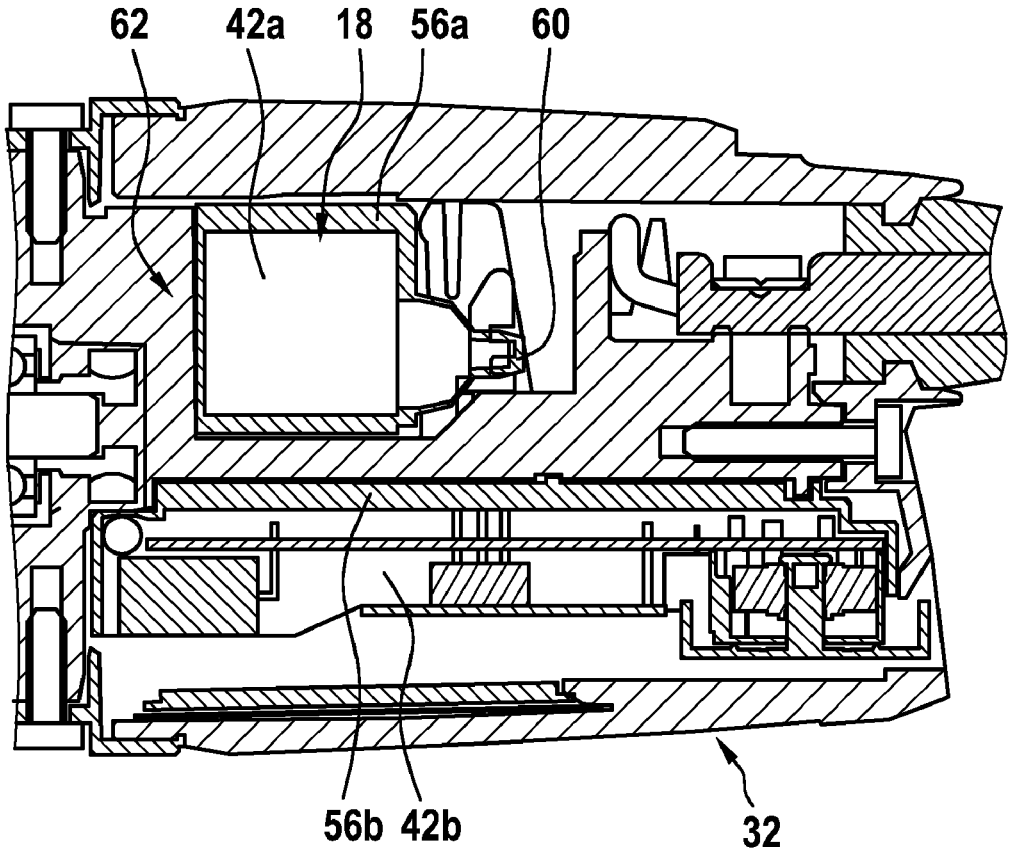
FIG. 2 shows a segment of a cross section of the portable power tool shown in FIG. 1.

FIG. 1 shows a portable power tool 12, which is formed by portable power tool 12 designed as an angle grinder. The portable power tool 12 comprises at least one switch unit 14, which has at least one actuating device 16 for actuation of at least one electric switch unit 18 (FIG. 2). A drive motor (not shown), which can be switched on and off by means of the switch unit 18, for driving a tool chuck 20 around a housing 22 is furthermore provided. The housing 22 extends along a direction of longitudinal extent 40 of the portable power tool 12.

The portable power tool 12 furthermore comprises a grip housing 26 designed as a housing cover, a drive housing 28 designed as a drive housing, and an output housing 30. In an alternative embodiment, however, the housing parts (26, 28) can be of single-part or integral design. The drive housing 28 has a housing inner part 32, which extends in the direction of the grip housing 26 and, in a state in which it is connected to the grip housing 26, is surrounded by the grip housing 26 designed as a housing cover.

Starting from a region of attachment 34 of the grip housing 26 to the drive housing 28, the grip housing 26 extends at least substantially in a direction of the grip housing 26 away from the region of attachment 34, in which a cable of the portable power tool 12 is arranged for the purpose of supplying power.

Suitable power tools here include both a fixed power tool, e.g. a bench saw in accordance with applications DE 102010042016 or U.S. Pat. No. 2,062,969 A and a non-fixed, portable power tool, e.g. a circular hand saw in accordance with application DE 3740200 A1 or, for example, a brush cutter that can be worn on the back, in accordance with application DE 19616764 A1.

FIG. 2 shows part of a cross section of the portable power tool through the plane 36 shown in FIG. 1. A drive (not shown) and two electronic devices 38*a*, 38*b*, each having an interface 40*a*, 40*b* for electrically connecting the electronic devices 38*a*, 38*b*, are accommodated in the housing 22. The drive housing 28 is formed in one piece with the housing inner part 32. In an assembled state of the portable power tool 12, the housing inner part 32 is surrounded by the grip housing 26. The housing inner part 32 of the drive housing 28 is intended to support an electronic device 38*a*, 38*b* in that the drive housing 28 at least partially surrounds the electronic devices 38*a*, 38*b*. The housing inner part 32 is intended to leave the electronic devices 38*a*, 38*b* exposed in an unassembled state of the portable power tool 12 and to support them positively and nonpositively in the housing inner part 32 in an assembled state. The housing inner part 32 is designed as a housing frame.

Figure 5:
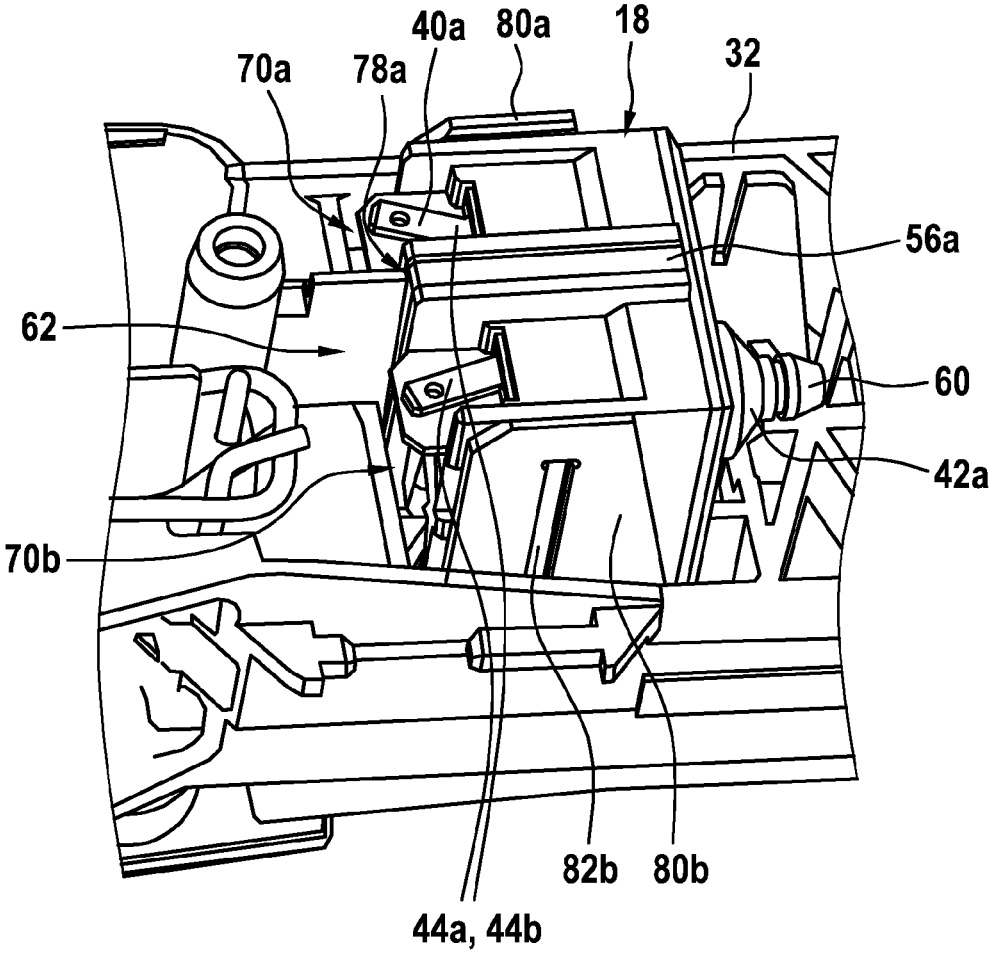
FIG. 5 shows another view of the electronic device.
Figure 6:
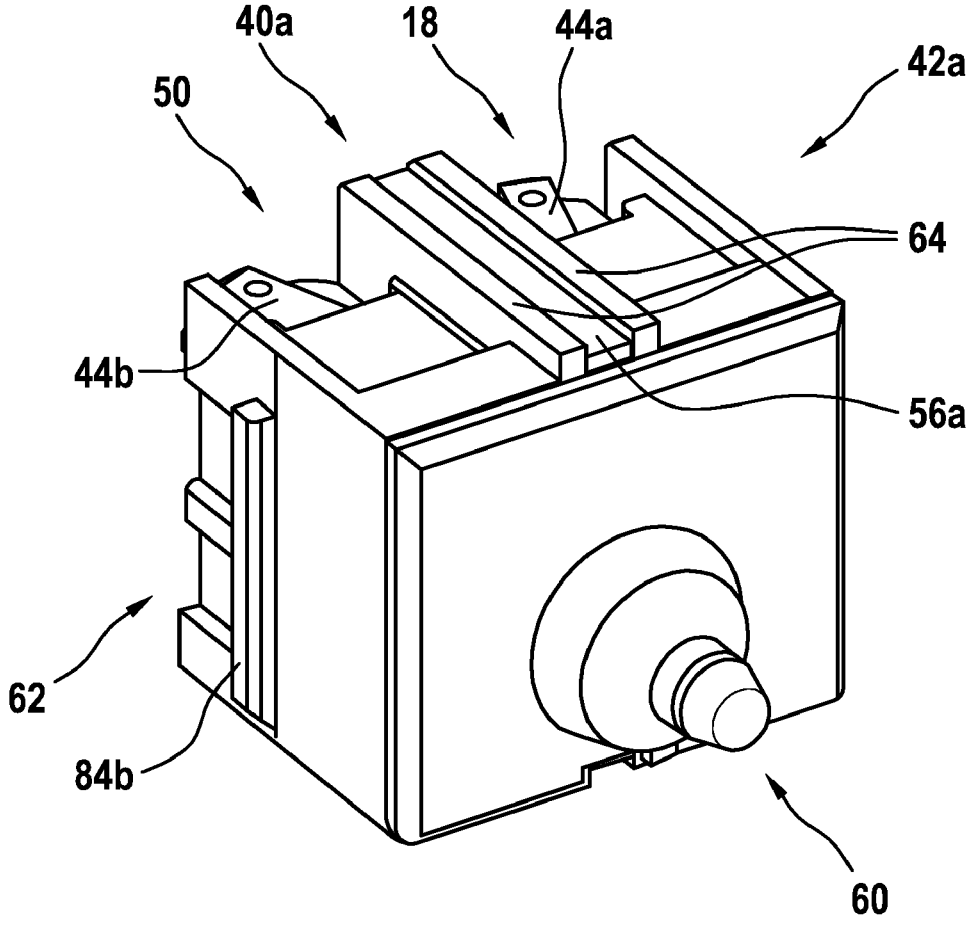
FIG. 6 shows a perspective view of the electronic device.
Figure 7:
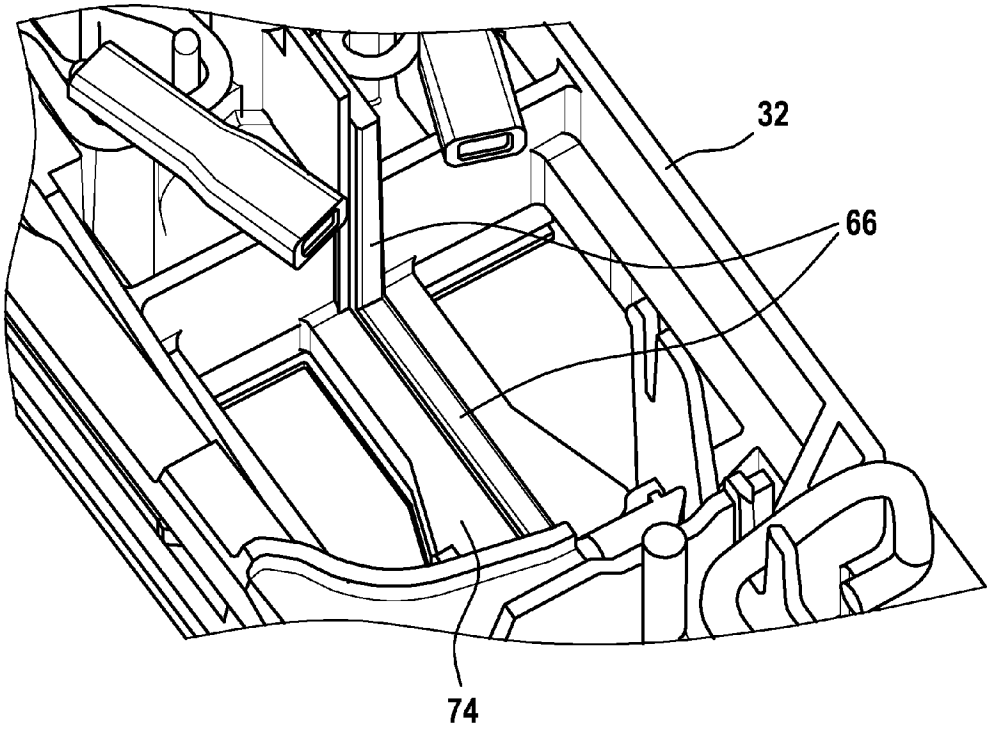
FIG. 7 shows a perspective view of a housing frame.
Figure 10:
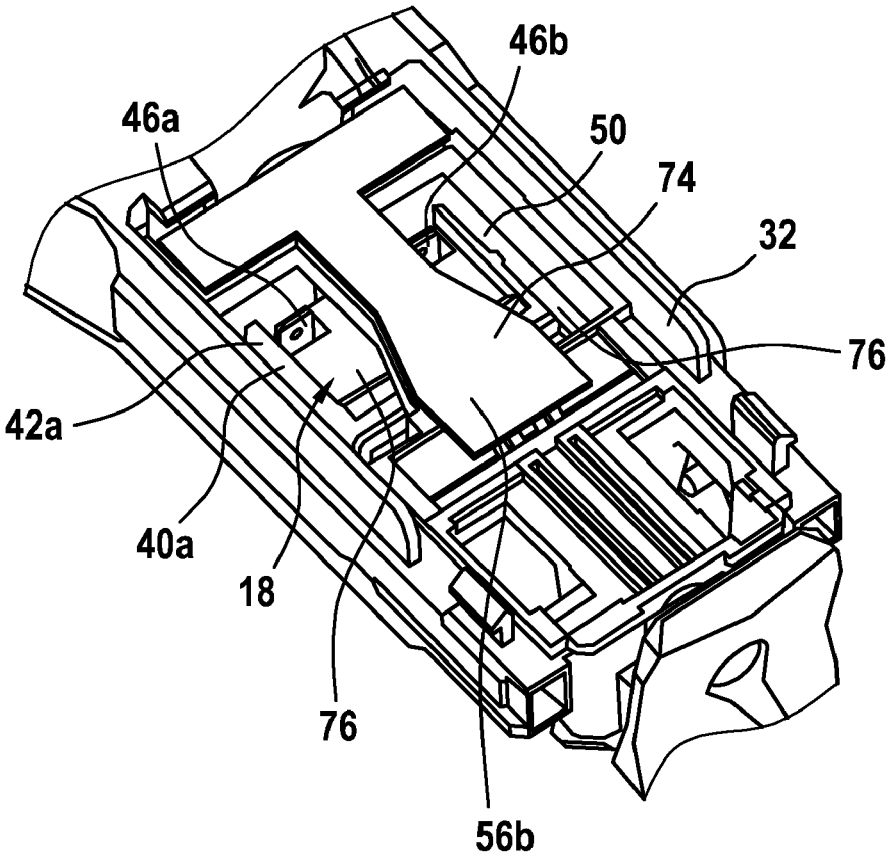
FIG. 10 shows another view of a housing frame.

The portable power tool 12 has two electronic devices 38*a*, 38*b*. One of the electronic devices 38*a* is designed as an on/off switch 42*a*. The interface 40*a* of the on/off switch 42*a* has four interface contact regions 44*a*, 44*b*, 46*a*, 46*b* (FIG. 5, FIG. 10). The four interface contact regions 44*a*, 44*b*, 46*a*, 46*b* are divided into a first interface contact region 44*a* and a second interface contact region 44*b*, which transmit an electric current from the on/off switch 42*a*, in particular directly, to the drive unit by means of two leads 48*a*, 48*b*, and into an additional first interface contact region 46*a* (FIG. 10) and an additional second interface contact region 46*b* (FIG. 10), which form an electrical connection to a further electronic device 38*a*. The interface contact regions 44*a*, 44*b*, 46*a*, 46*b* of the on/off switch 42*a* are arranged in an outer region 50 of the on/off switch 42*a* and are exposed in the outer regions 50 of the on/off switch 42*a*. The interface contact regions 44*a*, 44*b*, 46*a*, 46*b* protrude in the outer regions 50 of the on/off switch 42*a* in order to ensure good accessibility of the interface contact regions 44*a*, 44*b*, 46*a*, 46*b*.

The further electronic device 42*b* is designed as an open-loop and/or closed-loop control unit 42*b*. The interface 40*b* of the open-loop and/or closed-loop control unit 42*b* has at least one further first electrical interface contact region 52*a* and at least one further second interface contact region 52*b* spaced apart from the further first interface contact region 52*a*. The interface contact regions 52*a*, 52*b* are arranged in an outer region of the electronic device 42*b* and are exposed in the outer region 54 of the open-loop and/or closed-loop control unit 42*b*. The interface contact regions 52*a*, 52*b* protrude in the outer region 54 of the open-loop and/or closed-loop control unit 42*b* in order to ensure good accessibility of the interface contact regions 52*a*, 52*b*.

The additional interface contact regions 46*a*, 46*b* are designed as plug connectors and are intended to form an electrical connection to the further interface contact regions 52*a*, 52*b*, which are designed as plug sockets.

The portable power tool 12 has an insulating element 56*a*, which is arranged between the housing inner part 32 and the on/off switch 42*a*. The insulating element 56*a* is arranged at a distance from the interface contact regions 44*a*, 44*b*, 46*a*, 46*b*. The insulating element 56*a* is intended to avoid an electrical short-circuiting connection between the first interface contact region 44*a* and the second interface contact region 44*b*.

The portable power tool 12 has a further insulating element 56*b*, which is arranged between the housing inner part 32 and the open-loop and/or closed-loop control unit 42*b*. The further insulating element 56*b* is arranged at a distance from the further interface contact regions 46*a*, 46*b*. The further insulating element 56*b* is intended to avoid an electrical short-circuiting connection between the further first interface contact region 46*a* and the further second interface contact region 46*b*.

The insulating element 56*a*, 56*b* is formed in one piece or from a coherent part. The insulating element 56*a*, 56*b* is designed as a filling element. The insulating element 56*a*, 56*b* is designed to be elastically deformable. The insulating element 56*a*, 56*b* is designed as a one-piece shaped stamped part. The insulating element 56*a*, 56*b* contains a PU foam or consists thereof. The further insulating element 56*b* is of T-shaped design (FIG. 10). The insulating element 56*a*, 56*b* is designed as a film which has at least one film surface having a self-adhesive layer for connecting the film to the housing inner part 32 and/or to the on/off switch 42*a* or open-loop and/or closed-loop control unit 42*b*. The insulating element 56*a*, 56*b* is bonded onto a housing inner part 32 by means of the self-adhesive layer. As an alternative or in addition, the insulating element 56*a*, 56*b* can be bonded onto the electronic device 42*a*, 42*b* by means of the self-adhesive layer.

The insulating element 56*a*, 56*b* is intended to fill a clearance 58*a*, 58*b* between the housing inner part 32 and the electronic device 42*a* 42*b* or the on/off switch 42*a* and/or the open-loop and/or closed-loop control unit 42*b* in order to prevent deposition of metal chips in the clearance 58*a*, 58*b*. The clearance 58*a*, 58*b* has an extent of less than 1.2 mm between the housing inner part 32 and the on/off switch 42*a* or the open-loop and/or closed-loop control unit 42*b*.

The insulating element 56*a*, 56*b* is designed to be elastically deformable. The insulating element 56*a*, 56*b* has a material thickness which is greater than the clearance 58*a*, 58*b* between the housing inner part 32 and the on/off switch 42*a* or the open-loop and/or closed-loop control unit 42*b*, with the result that the insulating element 56*a*, 56*b* completely fills the clearance 58*a*, 58*b*. The insulating element 56*a*, 56*b* has a material thickness of about 0.8 or 0.6 mm.

The insulating element 56*a* is of C-shaped design and surrounds the on/off switch 42*a*. The insulating element 56*a*, 56*b* delimits at least three sides of the on/off switch 42*a* in at least one plane 36. The insulating element 56*a* is arranged on the on/off switch 42*a* in such a way that the insulating element 56*a*, 56*b* extends at least substantially in a direction away from the interface contact regions 44*a*, 44*b*, 46*a*, 46*b*.

The on/off switch 42*a* has a switch actuating element 60 designed as a push button, which is intended to actuate the on/off switch 42*a*. The interface contact regions 44*a*, 44*b*, 46*a*, 46*b* are arranged on a drive side 62 of the on/off switch 42*a*, said side facing away from the switch actuating element 60.

Figure 3:
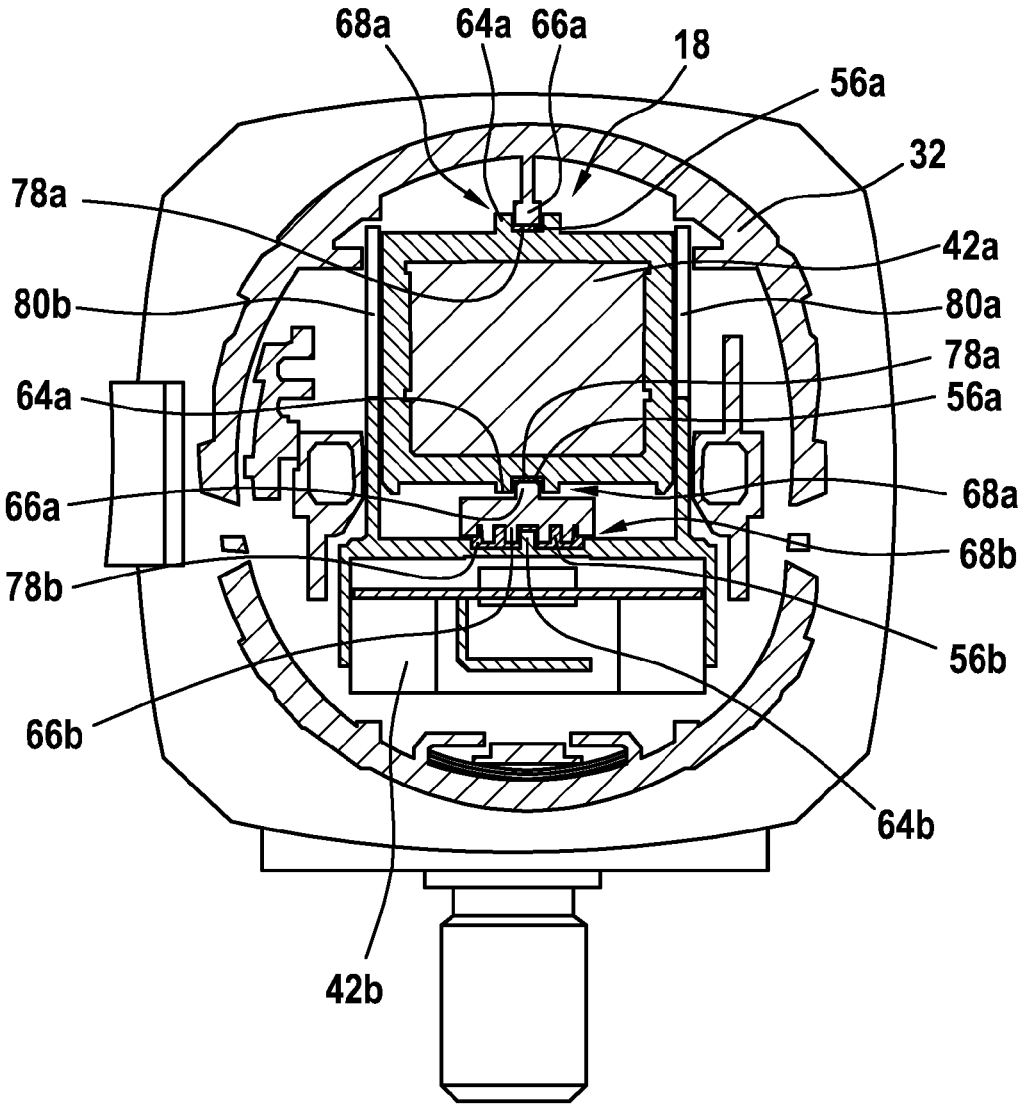
FIG. 3 shows a cross section of the portable power tools shown in FIG. 1.

The on/off switch 42*a* has a first labyrinth seal element 64*a* (FIG. 3). The housing inner part 32 has a second labyrinth seal element 66*a*. The insulating element 56*a* is arranged in or on the first labyrinth seal element 64*a* and is intended to prevent material transport of metal chips. In particular, the first labyrinth seal element 64*a* can be designed as a sealing groove. The second labyrinth seal element 66*a* is designed as a sealing protrusion. The first and/or the second labyrinth seal element 64*a*, 66*a* are/is intended to form a mutually corresponding labyrinth seal 68*a*. Through the combination of a labyrinth seal 68*a* with the insulating element 58*a*, material transport, e.g. of metal dust containing metal chips, can be avoided.

Similarly to the labyrinth seal 68*a*, the housing inner part 32 can have a further labyrinth seal 68*b*, which has a further first labyrinth seal element 64*b* on the open-loop and/or closed-loop control unit 42*b*, said element being designed as a sealing groove and/or as a sealing protrusion, and a further second labyrinth seal element 66*b* on the housing inner part 32, said element being designed as a sealing protrusion and/or sealing groove.

The insulating element 56*a*, 56*b* is designed as a flat insulating strip. The insulating element 56*a*, 56*b* is formed from a material through which it is impossible per se for dust, in particular metal dust, to flow, and therefore it is not possible for any metal chips/particles to pass through the insulating element 56*a*, 56*b*.

Figure 4:
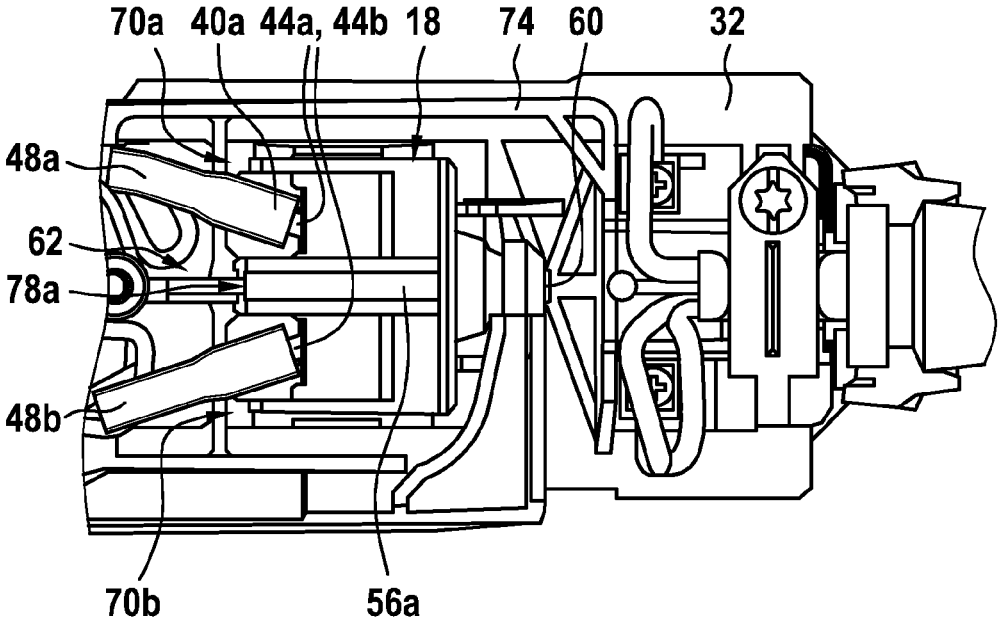
FIG. 4 shows a view of an electronic device.

In FIG. 4 and FIG. 5, the insulating element 56*a*, 56*b* forms a first chamber region 70*a* and a second chamber region 70*a* spaced apart from the first chamber region 70*a*, at least in some section or sections. The insulating element 56*a*, 56*b* separates the first chamber region 70*a* from the second chamber region 70*b*, at least in some section or sections, along a plane 36 which extends parallel to a main direction of extent 40 of the portable power tool 12. The first chamber region 70*a* has the first interface contact region 44*a*. The second chamber region 70*b* has the second interface contact region 44*b*.

Any properties and embodiments of the insulating element 56*a* which have been described are also intended to be applicable to the further insulating element 56*b*.

The portable power tool 12 has at least one lead (not shown), which is intended to carry electric current between the interface contact regions 44*a*, 44*b* and the additional interface contact regions 52*a*, 52*b*.

The on/off switch 42*a* is arranged on a first side of the housing inner part 32, and the open-loop and/or closed-loop control unit 42*b* is arranged on a second side of the housing inner part, which faces away from the first side. In an assembled state of the portable power tool 12, the additional interface contact regions 46*a*, 46*b* of the on/off switch 42*a* make contact with the further interface contact regions 52*a*, 52*b* of the open-loop and/or closed-loop control unit 42*b*. The on/off switch 42*a* and the open-loop and/or closed-loop control unit 42*b* are arranged opposite one another in an assembled state.

In an assembled state of the portable power tool 12, the further interface contact regions 52*a*, 52*b* of the open-loop and/or closed-loop control unit 42*b* are separated by a housing frame 74 of the housing inner part 32. In an assembled state, the further interface contact regions 52*a*, 52*b* each extend through two apertures 76 in the housing inner part 32, which are separated by the housing frame 74.

The further insulating element 56*a*, 56*b* is arranged substantially on the housing frame 74 of the housing inner part 32 and fills a clearance 78*a*, 78*b* between the open-loop and/or closed-loop control unit 42*b* and the housing frame 74 of the housing inner part 32.

Figure 8:
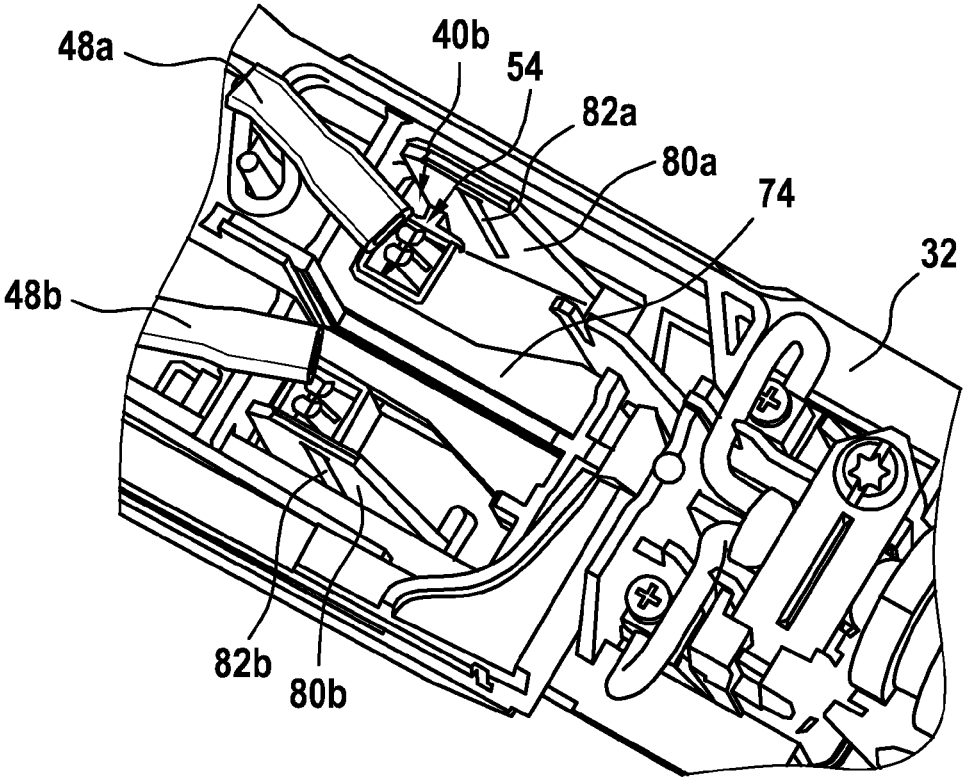
FIG. 8 shows another view of a housing frame.
Figure 9:
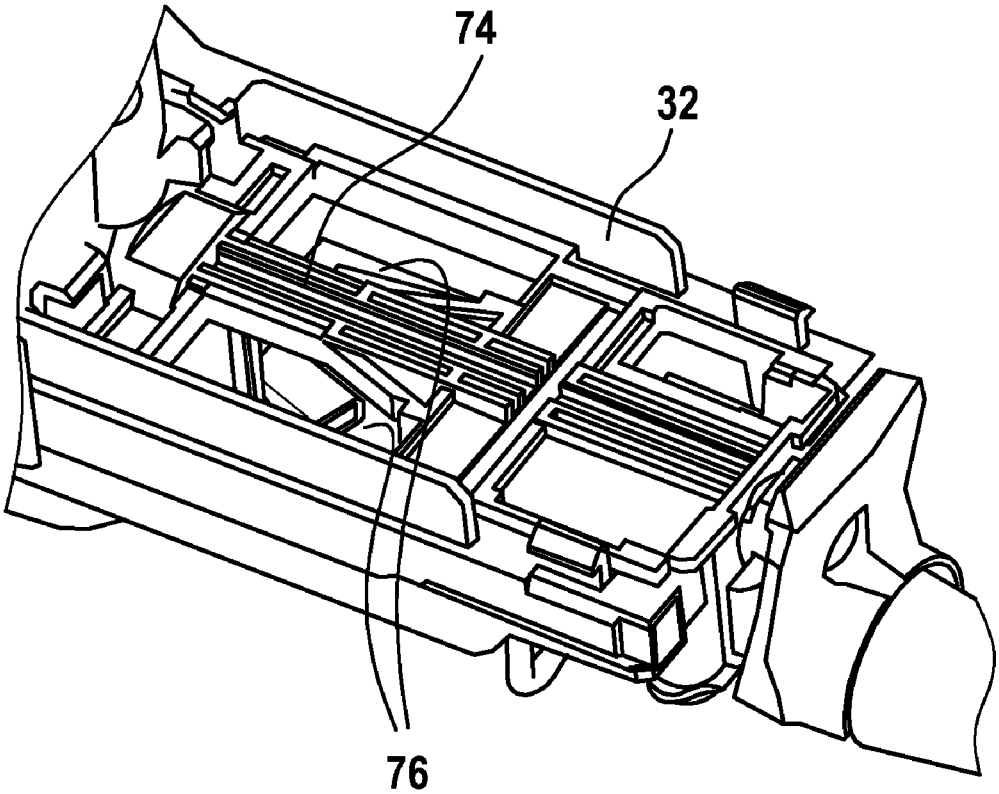
FIG. 9 shows another view of a housing frame.

The open-loop and/or closed-loop control unit 42*b* furthermore has two projecting holding arms 80*a*, 80*b* (FIG. 8), which each extend through the apertures 76 (FIG. 9) in the housing inner part 32 in an assembled state. The holding arms 80*a*, 80*b* each have a holding groove 82*a*, 82*b*, which is intended to interact with holding protrusions 84*a*, 84*b* (FIG. 8) of the on/off switch 42*a* in order to fix the on/off switch 42*a* relative to the open-loop and/or closed-loop control unit 42*b*. The holding arms 80*a*, 80*b* are designed as snap-fit arms.

In particular, the insulating element 56*a*, 56*b* can be provided between an electronic device and a magnetic wheel region, wherein the magnetic wheel region forms a region in the direct vicinity of the electric motor.

The invention claimed is:

1. A portable power tool, comprising:

a housing having at least one of a housing cover or a housing half-shell;

a drive arranged in the housing;

an electronic device arranged in the housing and having an interface configured to electrically connect the electronic device, the interface having at least one first electrical interface contact region and at least one second interface contact region that is spaced apart from the first interface contact region;

a housing inner part configured as a drive housing, the housing inner part supporting the electronic device; and at least one insulating element spaced apart from the first and second interface contact regions and arranged between the housing inner part and the electronic device, the insulating element configured to avoid an electrical short-circuiting connection between the first interface contact region and the second interface contact region, wherein the insulating element is configured as a filling element that fills a clearance between a surface of the housing inner part and a surface of the electronic device.

2. The portable power tool as claimed in claim 1, wherein:

the insulating element forms a first chamber region and a second chamber region, which is spaced apart from the first chamber region, the insulating element separates the first chamber region from the second chamber region, at least in one section, along a plane, and the first chamber region has the first interface contact region, and the second chamber region has the second interface contact region.

3. The portable power tool as claimed in claim 2, wherein the plane extends (i) parallel to a main direction of extent of the portable power tool or (ii) orthogonally to the main direction of extent of the portable power tool.

4. The portable power tool as claimed in claim 1, wherein the filling element is elastically deformable and is preloaded between the surface of the housing inner part and the surface of the electronic device so as to fill the clearance.

5. The portable power tool as claimed in claim 1, wherein the clearance has an extent between the surface of the housing inner part and the surface of the electronic device of less than 2 mm.

6. The portable power tool as claimed in claim 5, wherein the extent of the clearance is less than 0.6 mm.

7. The portable power tool as claimed in claim 1, wherein the electronic device is configured as one or more of an electric on/off switch, an electric open-loop control unit, and an electric closed-loop control unit.

8. The portable power tool as claimed in claim 7, wherein the insulating element surrounds the on/off switch in an L shape or C shape and delimits at least two sides or at least three sides of the electronic device in at least one plane.

9. The portable power tool as claimed in claim 1, wherein the insulating element surrounds the electronic device in an L shape or C shape and delimits at least two sides or at least three sides of the electronic device in at least one plane.

10. The portable power tool as claimed in claim 1, further comprising:

at least one further insulating element, which is configured to avoid an electrical short-circuiting connection between the first interface contact region and the second interface contact region, is arranged between the housing inner part and the electronic device.

11. The portable power tool as claimed in claim 10, wherein the electronic device is configured as an open-loop and/or closed-loop control unit, and wherein the at least one further insulating element is arranged between the housing inner part and the open-loop and/or closed-loop control unit.

12. The portable power tool as claimed in claim 1, wherein the insulating element is configured as an integral shaped stamped part that includes a foam.

13. The portable power tool as claimed in claim 12, wherein the foam is a polyurethane foam.

14. The portable power tool as claimed in claim 1, wherein the portable power tool is configured as an angle grinder.

15. The portable power tool as claimed in claim 1, wherein the clearance defined at least partially in a direction perpendicular to a main direction of extent of the power tool.

16. A portable power tool, comprising:

a housing having at least one of a housing cover or a housing half-shell;

a drive arranged in the housing;

an electronic device arranged in the housing and having an interface configured to electrically connect the electronic device, the interface having at least one first electrical interface contact region and at least one second interface contact region that is spaced apart from the first interface contact region;

a housing inner part that is configured as a drive housing and supports the electronic device; and at least one insulating element spaced apart from the interface contact regions and arranged between the housing inner part and the electronic device, the insulating element configured to avoid an electrical short-circuiting connection between the first interface contact region and the second interface contact region, wherein the insulating element is configured as a film with at least one film surface having a self-adhesive layer configured to connect the film to one or more of the housing inner part and the electronic device.

17. A portable power tool, comprising:

a housing having at least one of a housing cover or a housing half-shell;

a drive arranged in the housing;

an electronic device arranged in the housing and having an interface configured to electrically connect the electronic device, the interface having at least one first electrical interface contact region and at least one second interface contact region that is spaced apart from the first interface contact region;

a housing inner part that is configured as a drive housing and supports the electronic device; and at least one insulating element spaced apart from the interface contact regions and arranged between the housing inner part and the electronic device, the insulating element configured to avoid an electrical short-circuiting connection between the first interface contact region and the second interface contact region, wherein:

the electronic device has a first labyrinth seal element configured as a sealing groove, the housing inner part has a second labyrinth seal element configured as a sealing protrusion, and the insulating element is (i) arranged in or on one or more of the first labyrinth seal element and the second labyrinth seal element and (ii) configured to prevent material transport of metal chips.

18. The portable power tool as claimed in claim 17, wherein the electronic device is configured as an on/off switch.

* * * * *